United States Patent [19]

Ranney

[11] Patent Number: 4,631,647

[45] Date of Patent: Dec. 23, 1986

[54] WALL AND CEILING LIGHT DEVICE

[76] Inventor: Robert Ranney, Star Rte. 3 - Box 4950-31, Tehachapi, Calif. 93561

[21] Appl. No.: 831,859

[22] Filed: Feb. 24, 1986

[51] Int. Cl.[4] ..... F21S 1/02

[52] U.S. Cl. ..... 362/147; 362/153; 362/49

[58] Field of Search ..... 362/147, 367, 404, 433, 362/153, 49, 249, 806, 145, 226, 257, 260, 311

[56] References Cited

U.S. PATENT DOCUMENTS

| | | | |
|---|---|---|---|
| 3,721,050 | 3/1973 | Perina | 362/147 |
| 4,303,969 | 12/1981 | Hamilton et al. | 362/153 |
| 4,329,739 | 5/1982 | Loebner | 362/153 |
| 4,340,929 | 7/1982 | Konikoff et al. | 362/153 |

*Primary Examiner*—Raymond A. Nelli

*Attorney, Agent, or Firm*—John J. Posta, Jr.

[57] ABSTRACT

The light device is suitable for use on an interior wall and/or ceiling to provide a continuous uniformly lighted large wall or sheet of light for a unique effect. The device includes a rear support grid which is rigid and flat and adapted to be screwed or otherwise connected to a wall or ceiling. The grid can be, for example, of spaced interconnected translucent bars bearing rear wire-receiving channels. The grid bears electrical wiring for connection to an external power source, spaced electrical outlets on the front surface of the grid connected to the wiring, and a plurality of electrical light bulbs releasably connected to the outlets. A plurality of flat translucent panels with beveled outer edges are releasably held in edge to edge relation in front of the grid and parallel thereto by spaced translucent or transparent spacer legs. The panel edges preferably slope at 45° and alternate so that the panels form a continuous translucent sheet, but provide easy access to individual lights therebehind for replacement thereof as needed. The device is simple, efficient and inexpensive.

10 Claims, 6 Drawing Figures

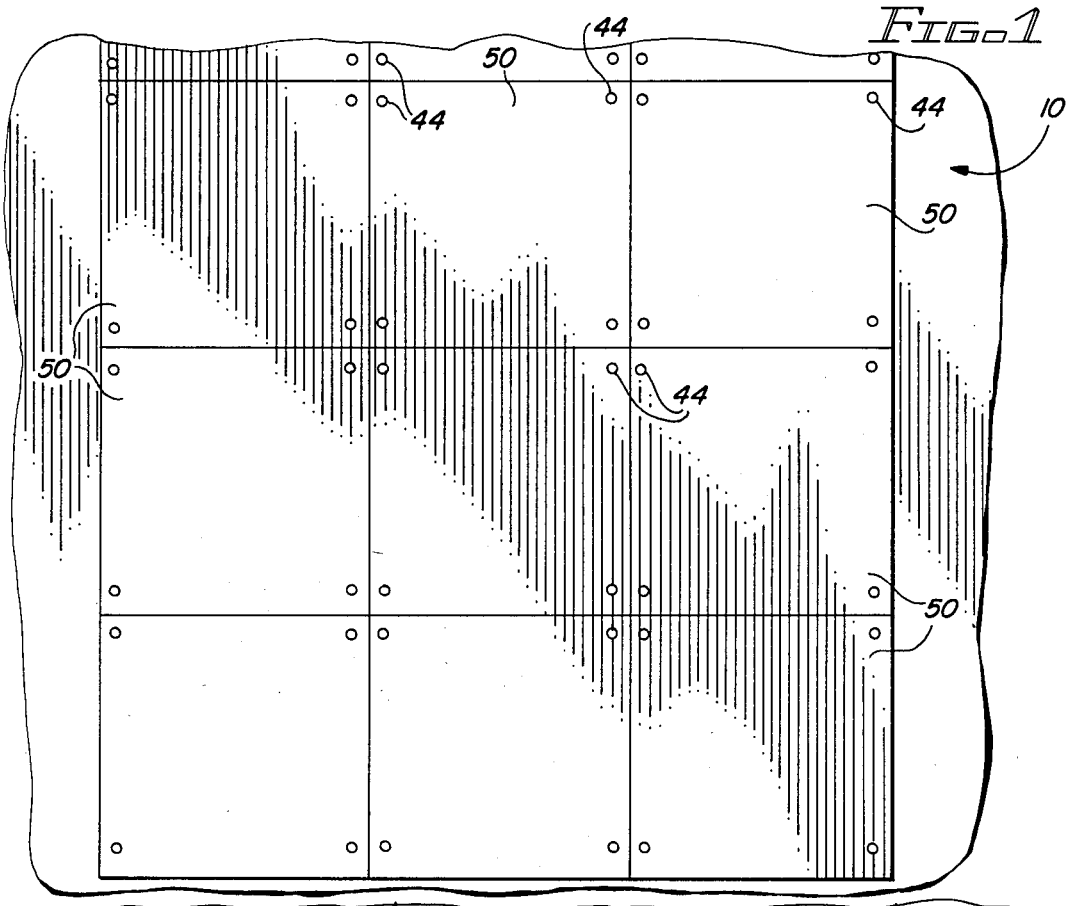
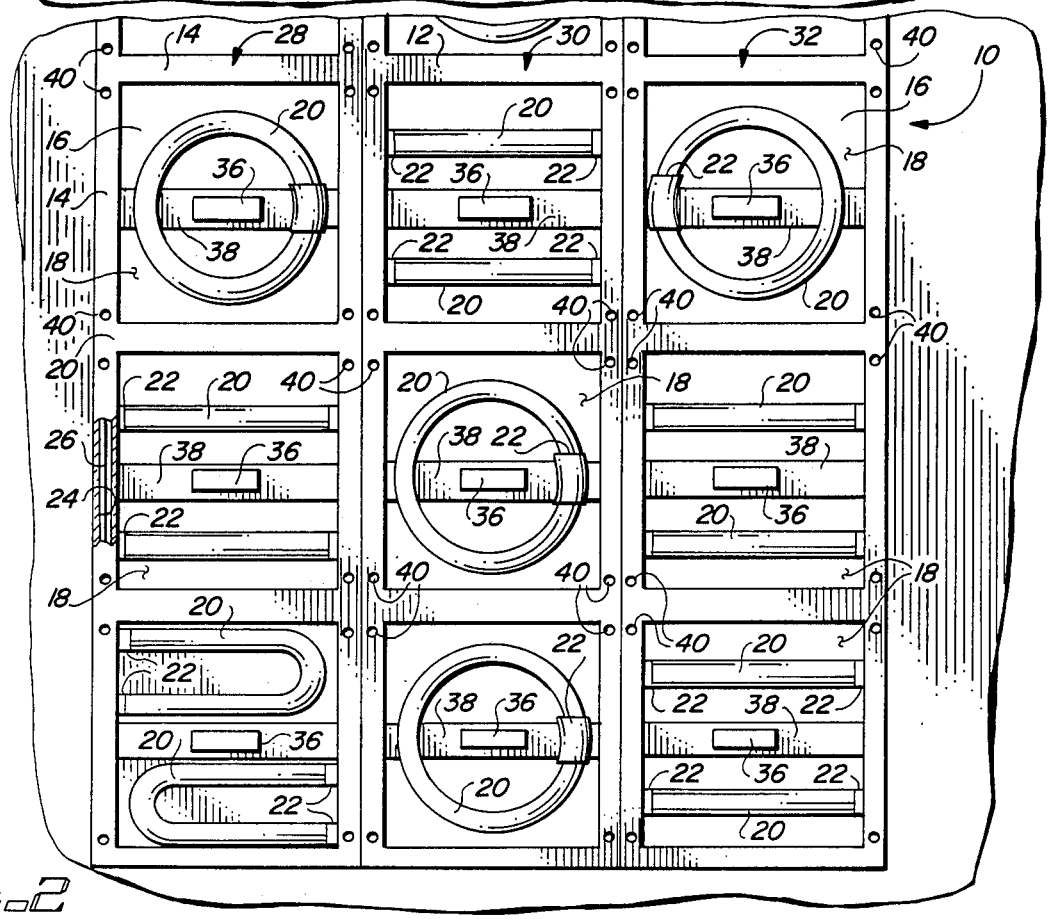
FIG. 2

WALL AND CEILING LIGHT DEVICE

BACKGROUND OF THE INVENTION

1. Field of the Invention

The present invention generally relates to interior electrical lighting devices and, more particularly, to an improved lighting device affording a continuous wall and/or ceiling of uniform light illumination.

2. Prior Art

Many electrical devices have been proposed for lighting areas of interior walls and/or ceilings. Certain of such devices are of extended surface area and include a number of spaced light bulbs. In most such instances access thereto for repair and replacement of the bulbs is difficult. Moreover, the front panels of such devices of any extended area are held in brackets, grids and the like which interpose solid, light-interfering support bars and the like between the light bulbs and the viewer, thus breaking up the illumination. It would be desireable to provide an improved wall and ceiling lighting device of simplified construction, easy accessibility to the lighting elements and improved illumination.

Certain devices have been proposed for dance floors and which provide light to an extended surface area, but have numerous drawbacks. See, for example, U.S. Pat. Nos. 4,329,739 and 4,340,929. In U.S. Pat. No. 4,309,739 a portable roll-up lighted disco dance floor is proposed which employs a CO2 generator and sequential lighting controls. The device comprises boxes or slots which are hinged together to permit them to be rolled up, each slot having its own fluorescent tube. Such a device is expensive and complicated and does not afford simultaneous easy access to a plurality of burned out bulbs. It also has little applicability to a wall and ceiling light device.

U.S. Pat. No. 4,340,928 discloses a dance floor having interlocked panels with light-interfering designs in or behind their upper surfaces. The panels each include male and female electrical and mechanical connectors and are very expensive and complicated to fabricate and assemble. The device is similar to that described above with respect to its deficiencies.

A far simpler device is disclosed in U.S. Pat. No. 4,100,025 for use in lighting a stage. It comprises a box with hinged reflective panels bearing angled foot lights. Such a device, however, does not provide uniform illumination over an extended area and could not be used effectively for wall and ceiling lighting.

Accordingly, there remains a need for a simple, inexpensive wall and ceiling lighting device which can provide a whole wall or ceiling of unimpeded uniform illumination, with easy access to the lighting elements. Such improved illumination would be better for reading and general viewing purposes and would provide a unique decorative effect.

SUMMARY OF THE INVENTION

The improved light device of the present invention satisfies all the foregoing needs. The device is substantially as set forth in the Abstract. Thus, the device includes a flat, preferably rigid rear grid bearing electrical wiring and spaced electrical bulb connectors, and with bulbs, incandescent, fluorescent or the like connected thereto, as well as means to releasably secure the grid to a wall or ceiling. A plurality of flat translucent front panels bearing beveled, preferably 45° sloped, outer edges are releasably held against each other in abutting relation parallel to and in front of the rear grid by a plurality of spaced translucent or transparent struts or legs engaging the panels and grid. The grid and array of panels can cover an entire wall or ceiling or both. Since the panels fit tightly together in supporting relation to each other, a continuous sheet of uniform of light is provided without light-interfering support bars in the way. Such a sheet or wall of light is very decorative and appealing as well as providing improved illumination for reading and general viewing, all with convenient access, through the individual panels, to all parts of the grid, for periodic bulb replacement.

Various other features of the invention are set forth in the following detailed description and accompanying drawings.

DRAWINGS

FIG. 1 is a schematic fragmentary front elevation of a first preferred embodiment of the improved wall and ceiling light device, showing the device mounted on the interior wall of a building;

FIG. 2 is a schematic fragmentary front elevation of the grid and light bulb portion of the device of FIG. 1;

DETAILED DESCRIPTION

FIGS. 1–3

Figure 3:
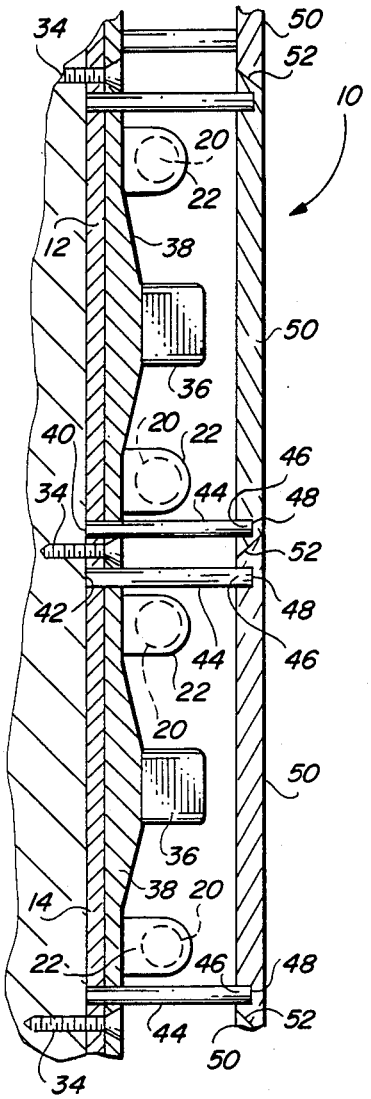
FIG. 3 is an enlarged fragmentary side elevation, partly broken away, of the device of FIG. 1, showing the device mounted on a wall.

Now referring more particularly to FIGS. 1–3 of the drawings, a first preferred embodiment of the improved wall and ceiling light device of the present invention is schematically depicted therein. Thus, device 10 is shown which comprises an open grid 12 (FIG. 2) of flat, rigid, supporting material, such as metal, plastic, glass, fiberglass-reinforced plastic, hard rubber, ceramic, wood or the like. Preferably, grid 12 is of translucent plastic, or can be another material painted or coated with a light-reflective coating of paint, etc. Grid 12 preferably comprises a plurality of spaced interconnected bars or rods 14, all of which preferably are integral, and define a plurality of cells or modules 16 having open central spaces 18 within and in front of which a lighting element, preferably in the form of a straight or curved fluorescent bulb or tube 20 is releasably electrically connected through connectors 22 to grid 12. Connectors 22 are attached to grid 12 and electrically connected through electrical wiring 24 to an external electrical power source (not shown). Wiring 24 for the most part may be disposed in channels 26 in the rear of grid 12. It will be understood that grid 12 can, if desired, be made in the form of releasably electrically interconnected abutting segments 28, 30 and 32 or can be made in one piece. Grid 12 is releasably mounted on an interior ceiling or wall, as by spaced screws 34 (FIG. 3) or the like.

When fluorescent tubes 20 are used, each module 16 can be provided with a conventional ballast 36 supported on a bracket 38 of the like connected to grid 12. Grid 12 may have a number of spaced holes 40 extending rearwardly part of the way therethrough and adapted to releasably receive the rear portions 42 (FIG. 3) of spacer legs 44, the front portions 46 of which are releasably or permanently received in pockets 48 of front panels 50. Preferably, legs 44 are transparent, although they could be translucent, in any event so as not to materially interfere with the passage of light from tubes 20 forward through panels 50. Legs 44 can be formed of glass, plastic or the like. In device 10, they are shown as generally cylindrical and there are four legs 44 for each square panel 50.

Panels 50 are translucent and preferably fabricated of glass, plastic or a mixture thereof. Panels 50 are flat and are releasably held in abutting relation to each other, in front of and parallel to grid 12. The outer edges 52 of each panel 50 are beveled and preferably slope at a 45° from front to rear. Adjacent panels 50 (FIG. 3) alternate in the direction of slope so that panels 50 abut in supporting relation to each other to provide an essentially continuous sheet which can extend to cover a whole wall or ceiling or large part thereof.

Each panel 50 can be conveniently small and provide easy access to tubes 20 therebehind. If a panel 50 is to be removed for access to space 18 therebehind and that panel 50 has edges which diverge rearwardly (e.g., the central panel 50 of the three shown in FIG. 3), the next adjoining panels 50 should be first removed. Such removal comprises pulling the panel(s) 50 forward so as to withdraw the associated legs 44 either from grid 12 or from the panel(s) 50 involved, preferably from grid 12. Replacement of tube 20 can then take place, followed by reseating of the affected panel(s) 50. Thus, installation and repair of device 10 are simple and rapid, and device 10 is inexpensive and durable, providing an uninterrupted sheet of illumination emanating from the continuous array of panels 50.

FIGS. 4–6

Figure 4:
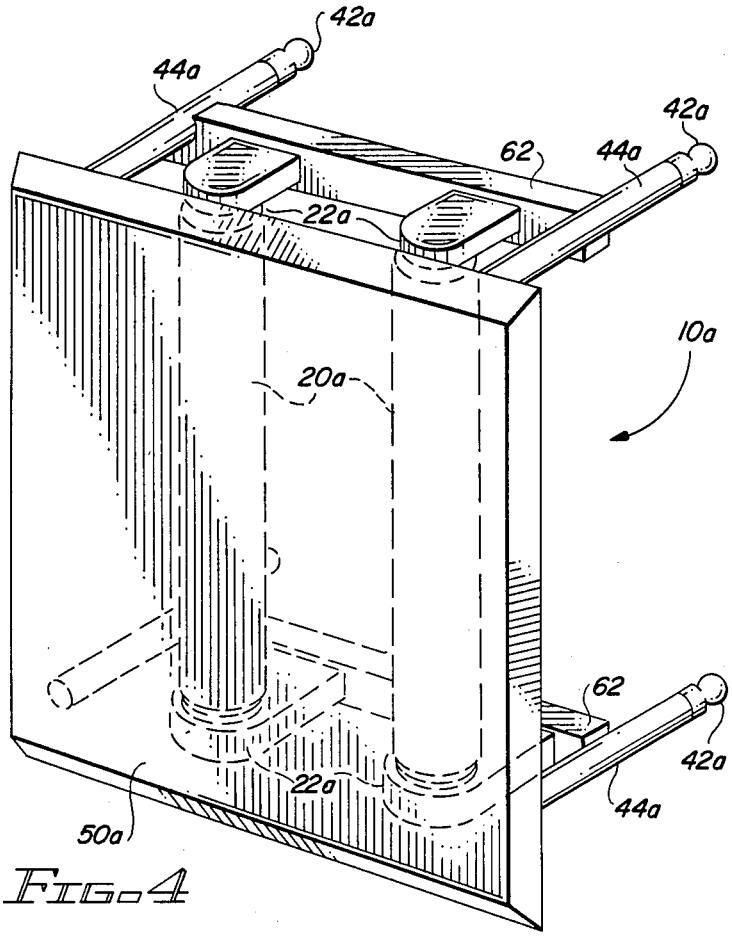
FIG. 4 is a schematic perspective view of a second preferred embodiment of the present invention, particularly of one light panel, four spacer legs, fluorescent bulb and electrical connectors utilizable in that embodiment.
Figure 6:
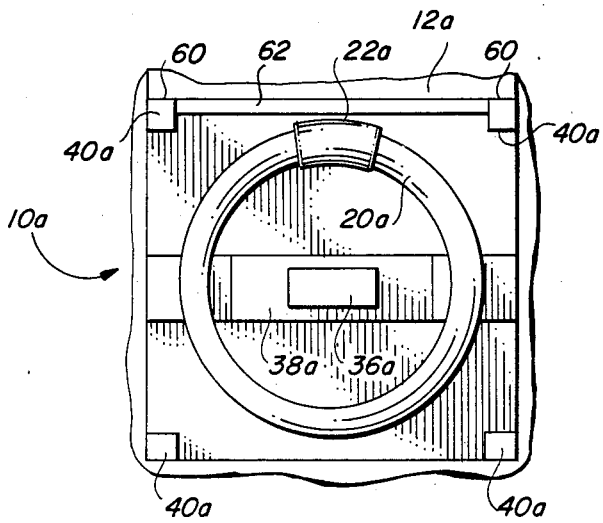
FIG. 6 is a second preferred embodiment of the improved light device.
Figure 5:
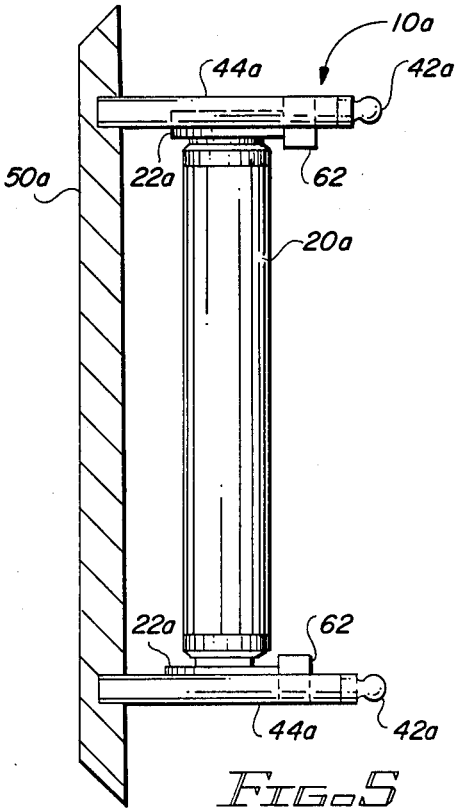
FIG. 5 is a schematic side elevation of the components of FIG. 4.

A second preferred embodiment of the improved light device of the present invention is schematically depicted in FIGS. 4–6. Thus, device **10*a* is shown. Components thereof similar to those of device 10** bear the same numerals, but are succeeded by the letter "a".

Device **10*a* is substantially identical to device 10 except in the following respects. Thus, legs 44*a* are generally square in cross section, rather than circular in cross-section, as are legs 44. Moreover, grid 12*a* is a flat plate bearing electrical connectors 60, linihg openings 40*a* which receive electrically conductive ends 42*a* of legs 44*a*. Ends 42*a* are electrically connected with an electrically conductive cross bar 62 (FIG. 4), in turn bearing connectors 22*a* releasably receiving tube 20*a*. Legs 44*a* are permanently connected to panels 50*a*. A ballast 36*a* may also be present on a bracket 38*a* in each space 18*a*. Device 10*a* has substantially the advantages of device 10**.

Various other modifications, changes, alterations and additions can be made in the improved wall and ceiling light device of the present invention, its components and their parameters. All such changes, modifications, alterations and additions as are within the scope of the appended claims form part of the present invention.

What is claimed is the following:

1. An improved interior wall and ceiling light device, said device comprising, in combination:

(a) a rigid, generally flat rear grid bearing electrical wiring, including means for connecting to an external power source, and also including spaced electrical outlets;

(b) a plurality of electrical lights releasably electrically connected to said spaced outlets;

(c) connector means for releasably connecting said grid to a building wall and a building ceiling;

(d) a plurality of flat translucent panels bearing beveled outer edges; and, (e) a plurality of spacer legs releasably spacing each of said panels in front of said grid and generally parallel thereto and releasably interconnecting said panels to said grid, said legs also releasably retaining said panels in abutting edge to edge relation to form a continuous translucent sheet, wherein said panels can be easily pulled away from adjacent panels and said grid for easy access to those electrical lights adjacent thereto, said light device when in operation providing a continuous wall of light of uniform illumination.

2. The improved device of claim 1 wherein said outer edges of said panels slope from front to rear at a uniform angle and wherein adjacent panels alternate in the direction of slope so that said panels fit together as an essentially single continuous sheet.

3. The improved device of claim 2 wherein said panels have a slope of about 45° at their outer edges and wherein said panels are either square or rectangular.

4. The improved device of claim 3 wherein said panels comprise material selected from the group consisting of glass, plastic and mixtures thereof.

5. The improved device of claim 1 wherein said grid comprises a plurality of interconnected spaced bars.

6. The improved device of claim 5 wherein said grid bars bear openings in which said spacer legs are releasably connected.

7. The improved device of claim 1 wherein said spacer legs are either translucent or transparent.

8. The improved device of claim 1 wherein said spacer legs are releasably received in sockets in said panels.

9. The improved device of claim 1 wherein said lights comprise fluorescent light bulbs and wherein said wiring is disposed behind said grid and extends through openings therein for connection to said electrical outlets affixed to the front of said grid.

10. The improved device of claim 1 wherein said grid is translucent and includes channels in the rear therein wherein said wiring is disposed.

* * * * *